US009653797B2

(12) United States Patent
Park et al.

(10) Patent No.: US 9,653,797 B2
(45) Date of Patent: May 16, 2017

(54) ANTENNA MODULE FOR NEAR FIELD COMMUNICATION

(71) Applicant: SAMSUNG ELECTRO-MECHANICS CO., LTD., Gyeonggi-Do (KR)

(72) Inventors: No Il Park, Gyeonggi-Do (KR); Yong Il Kwon, Gyeonggi-Do (KR); Chang Ryul Jung, Gyeonggi-Do (KR); Seung Wook Park, Gyeonggi-Do (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 189 days.

(21) Appl. No.: 14/335,713

(22) Filed: Jul. 18, 2014

(65) Prior Publication Data

US 2015/0048985 A1 Feb. 19, 2015

(30) Foreign Application Priority Data

Aug. 13, 2013 (KR) ..... 10-2013-0095877

(51) Int. Cl.
*H01Q 7/06* (2006.01)
*H01Q 1/52* (2006.01)

(52) U.S. Cl.
CPC ..... *H01Q 1/526* (2013.01); *H01Q 7/06* (2013.01)

(58) Field of Classification Search
CPC ..... H01Q 7/06; H01Q 1/526
See application file for complete search history.

(56) References Cited

U.S. PATENT DOCUMENTS 7,701,408 B2 * 4/2010 Bombay ..... G06K 19/025 343/700 MS
8,143,988 B2 * 3/2012 Hamano ..... H01F 17/0013 336/200
2012/0262348 A1 * 10/2012 Kubo ..... H01Q 1/2216 343/702
2013/0147023 A1 * 6/2013 Lin ..... H01L 23/5225 257/659
2013/0168809 A1 * 7/2013 Yen ..... H01L 23/5227 257/531
2014/0145807 A1 * 5/2014 Choi ..... H01F 38/14 335/302
2014/0225795 A1 * 8/2014 Yu ..... H01Q 19/30 343/767
2014/0247192 A1 * 9/2014 Ikemoto ..... G06K 7/10237 343/788
2016/0081240 A1 * 3/2016 Lee ..... H05K 9/0081 307/91

FOREIGN PATENT DOCUMENTS

KR 101282268 B1 7/2013

* cited by examiner

*Primary Examiner* — Trinh Dinh
(74) *Attorney, Agent, or Firm* — McDermott Will & Emery LLP

(57) ABSTRACT

Embodiments of the invention provide an antenna module for NFC. According to at least one embodiment, the antenna module includes an antenna sheet patterned with a loop coil of a conductive metal material, a magnetic shielding sheet comprising a metal sheet, which is embedded in a magnetic sheet, and an adhesive film interposed between the antenna sheet and the magnetic shielding sheet.

11 Claims, 4 Drawing Sheets

ANTENNA MODULE FOR NEAR FIELD COMMUNICATION

CROSS REFERENCE TO RELATED APPLICATION

This application claims the benefit of and priority under 35 U.S.C. §119 to Korean Patent. Application No. KR 10-2013-0095877, entitled "ANTENNA MODULE FOR NEAR FIELD COMMUNICATION," filed on Aug. 13, 2013, which is hereby incorporated by reference in its entirety into this application.

BACKGROUND

Field of the Invention

The present invention relates to a contactless wireless antenna module, and more particularly, to an antenna module for near field communication (NFC) or wireless charging.

Description of the Related Art

Recently, with the prevalence of smart phones, a contactless local wireless communication technology, which is one of the radio frequency identification (RFID) technologies, has emerged. the contactless local wireless communication technology may recognize and/or share the information in a contactless way using an antenna and a reader by propagating the information embedded in the RFID.

As well known to those skilled in the art, since portable electronics, such as smart phones adopting the REID or NFC technology are configured of high-density circuits and highly integrated devices, the portable electronics may disturb communication of the foregoing RFID or NFC due to electromagnetic waves to cause performance degradation.

To prevent a wireless antenna for REID or NFC equipped in the portable electronics from suffering from electromagnetic interference, various methods, such as a method of shielding the occurrence of electromagnetic waves and a method of absorbing electromagnetic waves have been sought. Korean Patent No. 10-1282268 discloses a small antenna for NFC, in which a ferrite substrate and an antenna pattern part printing a loop pattern are stacked.

Generally, the ferrite substrate solves a problem of a reduction in a communication range due to a loss which is caused by generation of eddy current of metal, thereby increasing the communication range of NFC. As a result, the ferrite substrate has been used as a core component of NFC. However, it has been known that ferrite materials may be changed due to a stress generated during a forming process and a stress generated during a firing process and may have less flexibility and permeability. Therefore, a need exists for a method of providing a wireless antenna module for NFC which may reliably absorb electromagnetic waves and have improved flexibility and permeability.

SUMMARY

Accordingly, embodiments of the invention have been made in an effort to provide contactless wireless antenna module with improved flexibility and permeability.

According to an embodiment of the invention, there is provided an antenna module for NFC, the antenna module including an antenna sheet patterned with a loop coil of a conductive metal material, a magnetic shielding sheet including a metal sheet, which is embedded in a magnetic sheet, and an adhesive film interposed between the antenna sheet and the magnetic shielding sheet.

According to an embodiment, the magnetic sheet is made of a ferrite based material.

According to an embodiment, the magnetic shielding sheet in which the metal sheet of which the circumference is enclosed with the magnetic sheet is embedded is applied.

According to an embodiment, the magnetic shielding sheet is made by stacking a ferrite based material on the metal sheet and integrally firing the metal sheet.

According to an embodiment, the metal sheet includes a plurality of punched through holes and a ferrite-based material for the magnetic sheet inserted into the plurality of through holes of the metal sheet to integrally form the metal sheet and the ferrite-based material at the time of firing.

According to another embodiment of the invention, there is provided an antenna module for NFC, the antenna module includes an antenna sheet patterned with a loop coil of a conductive metal material, a magnetic shielding sheet including a metal sheet and a magnetic sheet, and an adhesive film interposed between the antenna sheet and the magnetic shielding sheet.

According to an embodiment, the magnetic sheet is made of a ferrite based material.

According to an embodiment, the magnetic shielding sheet is made by integrally firing the metal sheet and the magnetic sheet, in which the metal sheet is stacked on an upper portion and the magnetic sheet is stacked on a lower portion. According to another embodiment, the metal sheet is stacked on the lower portion and the magnetic sheet is stacked on the upper portion.

According to an embodiment, the magnetic shielding sheet has a sandwich structure in which the respective metal sheets are disposed on and beneath the magnetic sheet.

According to an embodiment, the magnetic shielding sheet is made by stacking a ferrite based material between the metal sheets and integrally firing the metal sheet.

According to an embodiment, the metal sheet includes a plurality of punched through holes.

Various objects, advantages and features of the invention will become apparent from the following description of embodiments with reference to the accompanying drawings.

BRIEF DESCRIPTION OF DRAWINGS

These and other features, aspects, and advantages of the invention are better understood with regard to the following Detailed Description, appended Claims, and accompanying Figures. It is to be noted, however, that the Figures illustrate only various embodiments of the invention and are therefore not to be considered limiting of the invention's scope as it may include other effective embodiments as well

DETAILED DESCRIPTION

Figure 1:
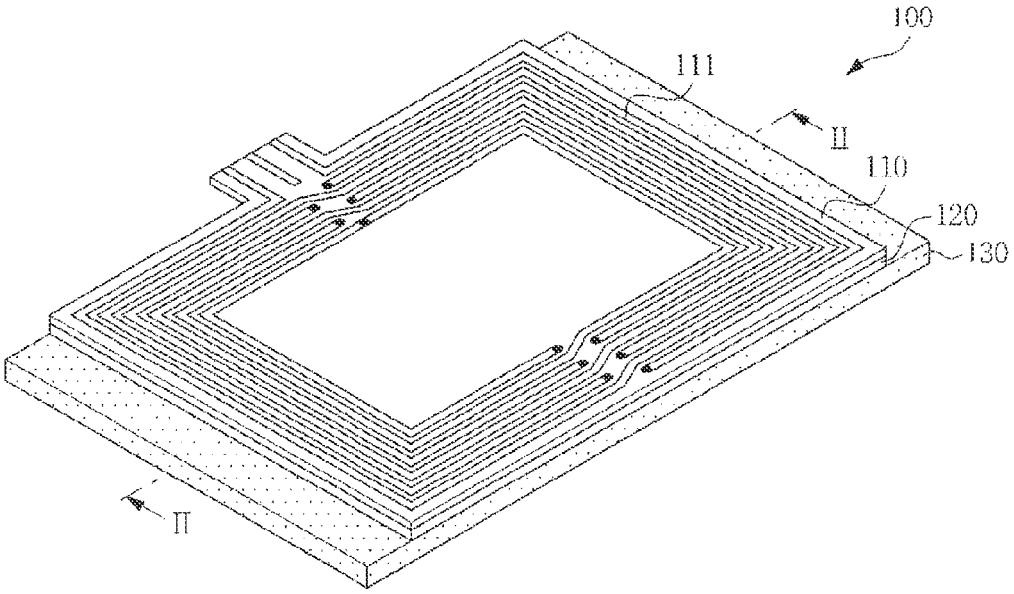
FIG. 1 is a perspective view schematically illustrating an antenna module for NFC according to a first embodiment of the invention

Advantages and features of the present invention and methods of accomplishing the same will be apparent by referring to embodiments described below in detail in connection with the accompanying drawings. However, the present invention is not limited to the embodiments disclosed below and may be implemented in various different forms. The embodiments are provided only for completing the disclosure of the present invention and for fully representing the scope of the present invention to those skilled in the art.

For simplicity and clarity of illustration, the drawing figures illustrate the general manner of construction, and descriptions and details of well-known features and techniques may be omitted to avoid unnecessarily obscuring the discussion of the described embodiments of the invention. Additionally, elements in the drawing figures are not necessarily drawn to scale. For example, the dimensions of some of the elements in the figures may be exaggerated relative to other elements to help improve understanding of embodiments of the present invention. Like reference numerals refer to like elements throughout the specification.

Hereinafter, various embodiments of the present invention will be described in detail with reference to the accompanying drawings.

Figure 2:
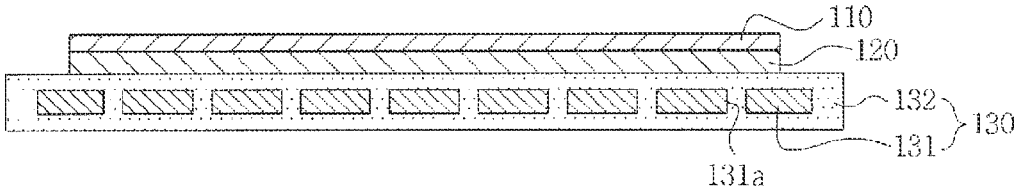
FIG. 2 is a cross-sectional view of an antenna module for NFC taken along the line II-II of FIG. 1 according to the first embodiment of the invention.

Referring to FIGS. 1 and 2, an antenna module 100 for NFC according, to a first embodiment of the invention is, for example, an antenna for near field communication and/or wireless charging, which does not suffer from electromagnetic interference.

As illustrated in FIGS. 1 and 2, the antenna module 100 for NFC according to the first embodiment of the invention is configured of an antenna sheet 110 and a hybrid type magnetic shielding sheet 130.

According to an embodiment, the antenna sheet 110 is patterned with a loop coil 111 of a conductive metal material on a thin substrate sheet. As well known, the loop coil 111 may be configured in a pattern of a flat coil, which is formed by winding a coil in a loop state. A vortex pattern of the loop coil 111 illustrated is illustrated as a rectangular shape, but is not limited thereto, and therefore is formed in a circular form or a mixed form of a rectangle and a circle.

According to the first embodiment of the invention, a magnetic shielding sheet 130 is stacked under the antenna sheet 110 and an adhesive film 120 is interposed between the antenna sheet 110 and the magnetic shielding sheet 130. As the adhesive film 120, a double-side tape, which bonds the antenna sheet 110 to the magnetic shielding sheet 130, is used.

According to an embodiment, the magnetic shielding sheet 130 is bonded to a lower surface of the antenna sheet 110, for example, a non-communication surface, and shields generation of electromagnetic waves at the antenna sheet 110 side or absorbs the electromagnetic waves to suppress electromagnetic interference.

According to an embodiment, the magnetic shielding sheet 130 is configured of a metal sheet 131 and a magnetic sheet 132 completely enclosing the metal sheet 131 and keeps a thin sheet form.

According to an embodiment, the metal sheet 131 is made of metal materials, such as aluminum and copper having high flexibility and permeability, and keeps the thin sheet form.

Further, according to an embodiment, the magnetic sheet 132 is made of a soft magnetic material as a magnetic substance. According to at least one embodiment of the invention, the magnetic sheet 132 forms a magnetic layer, which is made of for example, a sintered substance, such as ferrite, and has a sheet form. Generally, the ferrite-based magnetic sheet 132 forms the magnetic layer in the sheet state by mixing a magnetic powder of ferrite, a solvent, and additives, and finally firing the mixture.

As well known, the magnetic sheet 132 of a ferrite based material may have low flexibility and permeability. To overcome these disadvantages, the magnetic shielding sheet 130 according to an embodiment of the invention has the metal sheet 131 embedded therein.

In particular, the magnetic shielding sheet 130 has a hybrid type in which a ferrite powder is stacked on an outer circumferential surface of the metal sheet 131 and then the metal sheet 131 is integrally fired. As a result, the metal sheet 131 is certainly bonded to the magnetic sheet 132 to supplement disadvantages of a ferrite material and the metal sheet 131 is certainly bonded to the magnetic sheet 132 without an adhesive film required to bond the metal sheet 131 to the magnetic sheet 132.

Figure 3:
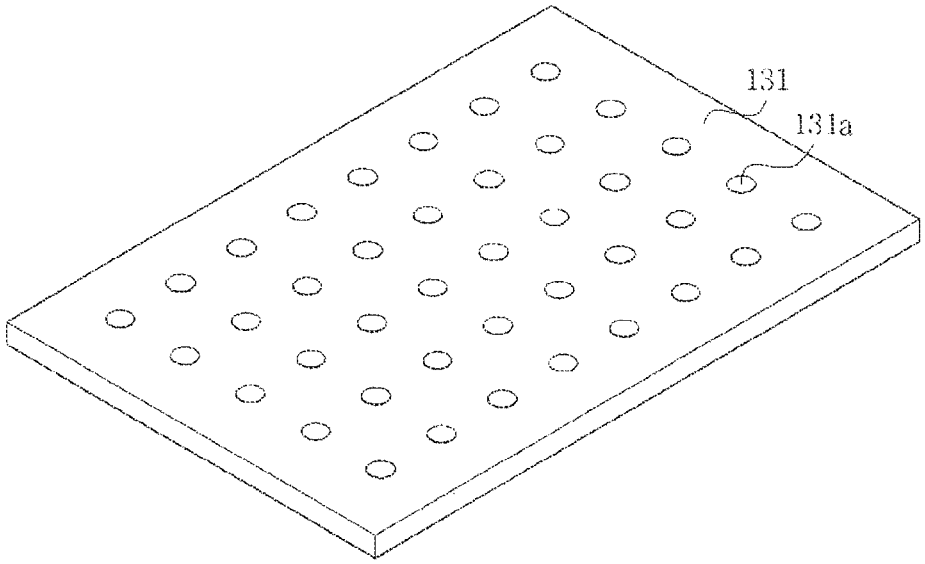
FIG. 3 is a diagram of a metal sheet adopted according to the first embodiment of the invention.

FIG. 3 is a diagram of a metal sheet adopted in the first embodiment of the invention.

According to an embodiment, the metal sheet 131 and the magnetic sheet 132 are integrally bonded by firing processing. To improve a bonding rate between the magnetic sheet 132 and the metal sheet 131 at the time of the firing processing, the metal sheet 131 is punched with a plurality of through holes 131*a*.

According to an embodiment, each through hole 131*a* provides a space through which the ferrite powder to be stacked at the outer circumferential surface of the metal sheet 131, that is, an upper surface and a lower surface thereof is introduced into the metal sheet 131 and the ferrite powder received in the through hole 131*a* is hardened together with a ferrite powder disposed on the metal sheet 131 and a ferrite powder disposed therebeneath by the firing processing to integrally form the magnetic sheets 132 (see FIG. 2) to be fired on and beneath the metal sheet 131, thereby more effectively bonding the respective sheets.

Figure 4:
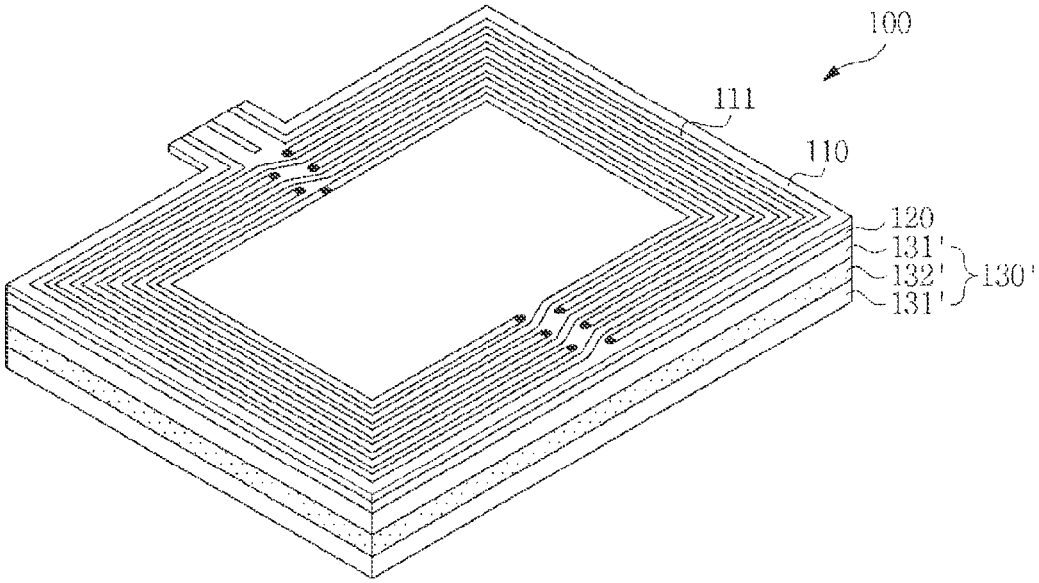
FIG. 4 is a perspective view schematically illustrating an antenna module for NFC according to a second embodiment of the invention.

FIG. 4 is a diagram schematically illustrating an antenna module for NFC according to a second exemplary embodiment of the present disclosure. The antenna module for NFC illustrated in FIG. 4 has a very similar structure except for the magnetic shielding sheet 130 of the antenna module 100 for NFC illustrated in FIGS. 1 and 2, and therefore the description of like or same components will be excluded herein to clearly understand the present disclosure.

According to an embodiment, the antenna module 100 for NFC according to the second embodiment of the invention is configured of the antenna sheet 110 and a magnetic shielding sheet 130'.

According to the second embodiment of the invention, the lower surface of the antenna sheet 100, in detail, the non-communication surface, is stacked with the magnetic shielding sheet 130', in which the adhesive film 120 is interposed between the respective sheets. As the adhesive film 120, a double-side tape is applied, but is not limited thereto, and therefore various members and methods required to bond the sheets may be applied.

According to an embodiment, in the magnetic shielding sheet 130' according to the second embodiment of the invention, the respective metal sheets 131' are disposed on and beneath a magnetic sheet 132' having a thin sheet form, respectively. The magnetic shielding sheet 130' shields generation of electromagnetic waves at the antenna sheet 110 side or absorbs the electromagnetic waves to suppress electromagnetic interference.

According to an embodiment, as illustrated in FIG. 4, the magnetic shielding sheet 130' keeps a sandwich structure in which one metal sheet 131', one magnetic sheet 132', and one metal sheet 131' are sequentially stacked.

According to an embodiment, the metal sheet 131' is made of metal materials, such as aluminum and copper having high flexibility and permeability, and keeps the thin sheet form.

According to an embodiment, the magnetic sheet 132' is made of a soft magnetic material as a magnetic substance. According to an embodiment of the invention, the magnetic sheet 132' forms a magnetic layer, which is made of a sintered substance, such as ferrite, and has a sheet form. Generally, the ferrite based magnetic sheet 132' forms the magnetic layer in the sheet state by mixing a magnetic powder of ferrite, a solvent, and additives, and finally firing the mixture.

According to an embodiment, the magnetic sheet 132' made of the ferrite based material has disadvantages of low flexibility and permeability and may guarantee the flexibility and permeability of the magnetic shielding sheet 130' due to the metal sheets 131', which are each stacked on and beneath the magnetic sheet 132'.

According to an embodiment, the magnetic shielding sheet 130' according to an embodiment of the invention has a hybrid type in which the ferrite powder is interposed (or stacked) between the two metal sheets 131' arranged to be spaced apart from each other in parallel, and then the two metal sheets 131' are integrally fired. As a result, the metal sheet 131', is certainly bonded to the magnetic sheet 132' to supplement disadvantages of a ferrite material and the metal sheet 131' is certainly bonded to the magnetic sheet 132' without an adhesive film required to bond the metal sheet 131' to the magnetic sheet 132'.

As well known, the magnetic sheet 132' to be formed with the ferrite based powder may be warped due to contraction or thermal expansion during sintering. To prevent this, one surface or both surfaces of the magnetic sheet 132', according to an embodiment of the invention, needs to be separately provided with a contraction control sheet. According to an embodiment of the invention, the two metal sheets 131' having the same thermal expansion are disposed on and beneath the ferrite based powder for the magnetic sheet 132' to prevent the magnetic sheet 132' from being warped and/or distorted during the firing processing, thereby providing the magnetic shielding sheet 130' having a flat sheet form.

The metal sheets 131' disposed on and beneath the ferrite based powder are equally expanded during sintering the magnetic shielding sheet 130' according to an embodiment of the invention at high temperature, and thus a stress is equally generated on both surfaces of the magnetic sheet 132', such that the magnetic sheet 132' is sintered while keeping the flat state without being warped or distorted to one side.

Figure 5A:
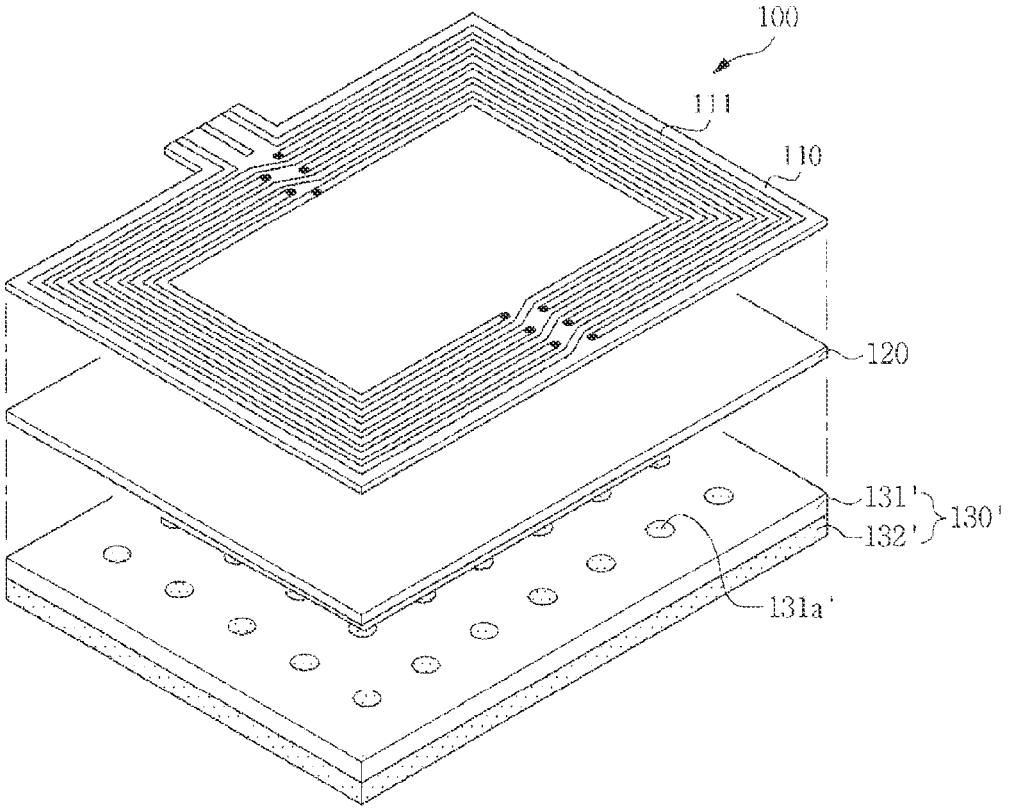
FIG. 5A is an exploded perspective view of another antenna module for NFC according to the second embodiment of the invention.

Optionally, to improve a bonding rate between the metal sheet 131' and the magnetic sheet 132' at the time of the firing processing, the metal sheet 131' is punched with a plurality of through holes 131*a'* (see FIG. 5A).

According to an embodiment, each through hole 131*a'* provides a space through, which the ferrite powder is introduced into the metal sheet 131' and the ferrite powder received in the through hole 131*a'* is hardened together with the ferrite powder disposed between the metal sheets 131' by the firing processing to increase a contact area between the metal sheet 131' and the magnetic sheet 132', thereby maximizing bonding efficiency between the thin sheets.

Figure 5B:
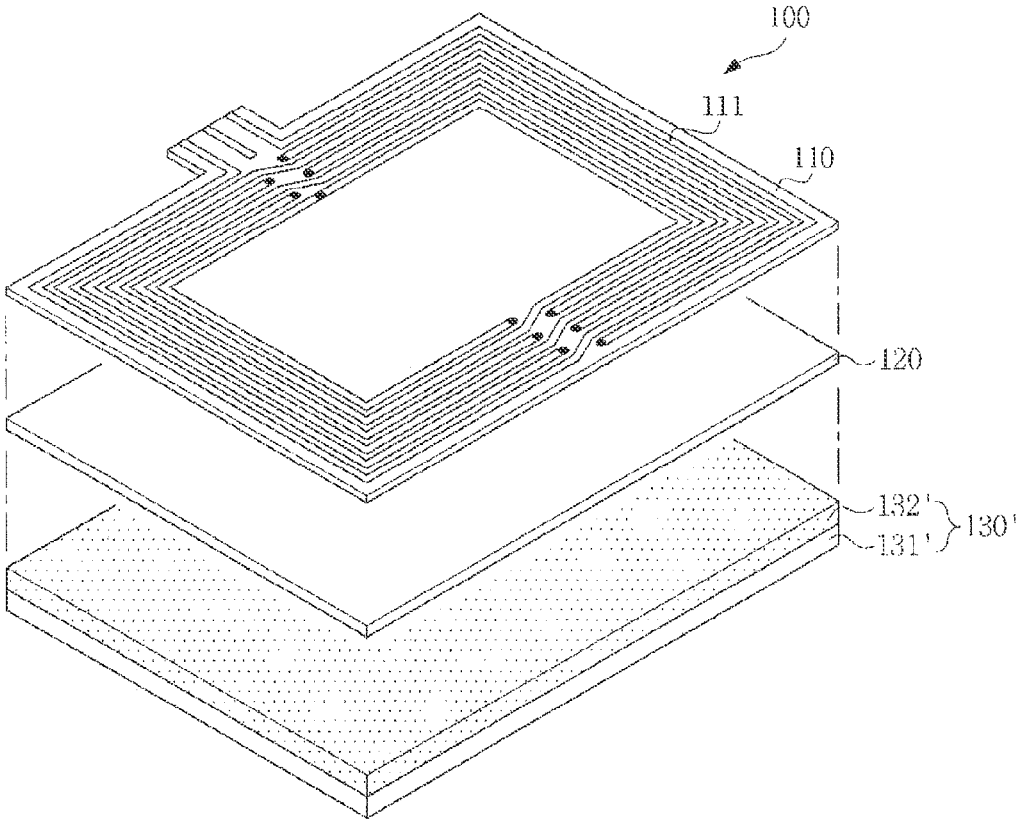
FIG. 5B is an exploded perspective view of another antenna module for NFC according to the second embodiment of the invention.

FIGS. 5A and 5B illustrate a modification example of the antenna module for NFC according to the second embodiment of the invention illustrated in FIG. 4, and illustrate the magnetic shielding sheet 130' having the sandwich structure which is structurally simple.

In the magnetic shielding sheet 130', according to the second embodiment of the invention, the one metal sheet 131' is bonded to the one magnetic sheet 132' by the firing processing. FIG. 5A illustrates that the metal sheet 131' and the magnetic sheet 132' are sequentially stacked, while FIG. 5B illustrates that the magnetic sheet 132' and the metal sheet 131' are stacked in an inverse order.

According to the modification example, it is possible to more effectively provide the thin sheet than the magnetic shielding sheet having the sandwich structure of FIG. 4 and improve the flexibility and permeability of the magnetic sheet by the metal sheet. Further, the metal sheet is provided with the plurality of through holes 131*a'* through which the ferrite based powder is introduced at the time of the firing processing, thereby minimizing the warpage phenomenon of the magnetic sheet while guaranteeing the bonding between the respective sheets despite the reduction in the thickness of the shielding sheet.

Further, embodiments of the invention also adopt the magnetic shielding sheet in which the magnetic shielding sheet 130 of the antenna module for NFC according to the first embodiment of the invention is combined with the magnetic shielding sheet 130' of the antenna module for NFC according to the second embodiment of the invention.

As set forth above, according to various embodiments of the invention, the contactless wireless antenna module adopts the magnetic sheet and the metal sheet, thereby guaranteeing the reliable flexibility and permeability.

In particular, according to various embodiments of the invention, the metal sheet is embedded in the ferrite based magnetic sheet to remove the adhesive film between the magnetic sheet and the metal sheet to reduce the thickness of the antenna for NFC, thereby implementing the miniaturization and thinness of the antenna for NFC.

Further, according to various embodiments of the invention, the metal sheet and the magnetic sheet are integrated by being fired to be stacked in the sandwich structure, thereby providing the antenna for NFC guaranteeing the reliable flexibility and permeability.

In addition, according to various embodiments of the invention, the stress and change of the ferrite based magnetic sheet are minimized by the metal sheet, thereby improving the durability of the antenna for NFC.

Terms used herein are provided to explain embodiments, not limiting the present invention. Throughout this specification, the singular form includes the plural form unless the context clearly indicates otherwise. When terms "comprises" and/or "comprising" used herein do not preclude existence and addition of another component, step, operation and/or device, in addition to the above-mentioned component, step, operation and/or device.

Embodiments of the present invention may suitably comprise, consist or consist essentially of the elements disclosed and may be practiced in the absence of an element not disclosed. For example, it can be recognized by those skilled in the art that certain steps can be combined into a single step.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to describe the best method he or she knows for carrying out the invention.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Similarly, if a method is described herein as comprising a series of steps, the order of such steps as presented herein is not necessarily the only order in which such steps may be performed, and certain of the stated steps may possibly be omitted and/or certain other steps not described herein may possibly be added to the method.

The singular forms "a," "an," and "the" include plural referents, unless the context clearly dictates otherwise.

As used herein and in the appended claims, the words "comprise," "has," and "include" and all grammatical variations thereof are each intended to have an open, non limiting meaning that does not exclude additional elements or steps.

As used herein, the terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical or non-electrical manner. Objects described herein as being adjacent to each other may be in physical contact with each other, in close proximity to each other, or in the same general region or area as each other, as appropriate for the context in which the phrase is used. Occurrences of the phrase "according to an embodiment" herein do not necessarily all refer to the same embodiment.

Ranges may be expressed herein as from about one particular value, and/or to about another particular value. When such a range is expressed, it is to be understood that another embodiment is from the one particular value and/or to the other particular value, along with all combinations within said range.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

What is claimed is:

1. An antenna module comprising:
- an antenna sheet patterned with a loop coil of a conductive metal material;
- a magnetic shielding sheet comprising a metal sheet, which is embedded in a ferrite sheet; and
- an adhesive film interposed between the antenna sheet and the magnetic shielding sheet,
- wherein the metal sheet comprises a plurality of through holes, and
- the through holes are filled with a same ferrite based material as the ferrite sheet.

2. The antenna module of claim 1, wherein the metal sheet is enclosed with the ferrite sheet.

3. The antenna module of claim 1, wherein the magnetic shielding sheet is made by stacking a ferrite based material on the metal sheet and integrally firing the metal sheet.

4. The antenna module of claim 1, wherein the adhesive film is a double-side tape,
- one side of the double-side tape is attached to the ferrite sheet, and
- another side of the double-side tape is attached to the metal sheet.

5. The antenna module of claim 1, wherein the metal sheet and the ferrite sheet are bonded to each other without other adhesive material.

6. An antenna module comprising:
- an antenna sheet patterned with a loop coil of a conductive metal material;
- a magnetic shielding sheet comprising a metal sheet and a ferrite sheet; and
- an adhesive film interposed between the antenna sheet and the magnetic shielding sheet,
- wherein the metal sheet comprises a plurality of through holes, and
- the through holes are filled with a same ferrite based material as the ferrite sheet.

7. The antenna module of claim 6, wherein the magnetic shielding sheet is made by integrally firing the metal sheet and the ferrite sheet.

8. The antenna module of claim 6, wherein the magnetic shielding sheet comprises two metal sheets and has a sandwich structure in which the two metal sheets are respectively disposed on and beneath the ferrite sheet.

9. The antenna module of claim 8, wherein the magnetic shielding sheet is made by stacking a ferrite based material between the two metal sheets and integrally firing the two metal sheets.

10. The antenna module of claim 6, wherein the adhesive film is a double-side tape,
- one side of the double-side tape is attached to the ferrite sheet, and
- another side of the double-side tape is attached to the metal sheet.

11. The antenna module of claim 6, wherein the metal sheet and the ferrite sheet are bonded to each other without other adhesive material.

* * * * *